US005836291A

United States Patent [19]

Kinugasa et al.

[11] Patent Number: 5,836,291

[45] Date of Patent: Nov. 17, 1998

[54] EVAPORATED FUEL PROCESSING APPARATUS FOR AN INTERNAL COMBUSTION ENGINE

[75] Inventors: Yukio Kinugasa, Susono; Takaaki Itou, Misima; Yoshihiko Hyodo, Susono; Toru Kidokoro, Hadano; Naoya Takagi, Susono, all of Japan

[73] Assignee: Toyota Jidosha Kabushiki Kaisha, Aichi, Japan

[21] Appl. No.: 862,042

[22] Filed: May 22, 1997

[30] Foreign Application Priority Data

May 30, 1996 [JP] Japan ..... 8-136946

[51] Int. Cl.[6] ..... F02D 41/04; F02D 41/14

[52] U.S. Cl. ..... 123/679; 123/520

[58] Field of Search ..... 123/679, 698, 123/520, 521; 180/167

[56] References Cited

U.S. PATENT DOCUMENTS 5,485,824 1/1996 Kondou ..... 123/520
5,515,937 5/1996 Adler et al. ..... 180/65.2
5,596,972 1/1997 Sultan et al. ..... 123/520

FOREIGN PATENT DOCUMENTS

5297941 A 11/1993 Japan .
6272753 A 9/1994 Japan .
7107617 A 4/1995 Japan .
7192194 A 7/1995 Japan .

*Primary Examiner*—Andrew M. Dolinar
*Attorney, Agent, or Firm*—Kenyon & Kenyon

[57] ABSTRACT

An evaporative fuel processing apparatus which can optimally process fuel gas according to navigation information or the like. This apparatus obtains future running information from a navigation system and further predicts an amount quantity of fuel vapor generated in a fuel tank (13) according to the running information. Further, the apparatus determines an amount of fuel vapor to be purged from a canister (14), namely, a valve opening of a purge control valve (142) so that an amount of fuel vapor adsorbed in the canister (14) is not more than a predetermined upper limit and that an amount of fuel adsorbed in the canister (14) after running is almost zero. Thus, an evaporation emission is reduced and the durability of the canister is prolonged by controlling the purge control valve.

22 Claims, 9 Drawing Sheets

EVAPORATED FUEL PROCESSING APPARATUS FOR AN INTERNAL COMBUSTION ENGINE

BACKGROUND OF THE INVENTION

1. Field of the Invention

The present invention generally relates to an evaporated fuel processing apparatus for an internal combustion engine, and, more particularly, to an evaporated fuel processing apparatus for an internal combustion engine, enabled to optimally process fuel vapor according to navigating information or the like.

2. Prior Art

In recent years, there have been cases where a navigation system and/or a vehicle information and communication system has been mounted on a motor vehicle so as to make the operating thereof easy.

The use of these systems enables to predict the future running condition of the motor vehicle (for example, an engine speed and a load). Consequently, the optimal control of the future operating variables of the motor vehicle (for instance, a gear ratio, a target air-fuel ratio and an irradiating direction of headlights) can be achieved (see the Japanese Unexamined Patent Publication (Kokai) No. 7-192194).

On the other hand, fuel stored in a fuel tank: is led to fuel injection valves which inject the fuel into the internal combustion engine, Not only because surplus fuel returns to the fuel tank after being heated by the internal combustion engine, but also because air warmed by a radiator flows under the bottom surface (of the floorboard) of the motor vehicle, the temperature of the fuel contained in the fuel tank is raised, so that the fuel is evaporated to the vapor.

This fuel vapor must not be directly released into the atmosphere from the viewpoint of preventing atmospheric pollution. Therefore, it is general practice that, after being once adsorbed in a canister, the fuel vapor is purged into an intake pipe on every suitable occasion to use as fuel.

Because the fuel vapor purged into the intake pipe acts as a disturbance to an air-fuel ratio control, the amount of the purged fuel vapor is restricted within a range where it does not deteriorate an air-fuel ratio control accuracy and the amount of fuel vapor absorbed in the canister is also reduced by increasing the amount of the purged fuel vapor as much as possible.

According to the prior art, because the amount of the purged fuel vapor is controlled without predicting the future operating conditions of the motor vehicle (especially, the future operating conditions of the internal combustion engine), the fuel vapor adsorbed in the canister may not be sufficiently purged, so that the canister cannot absorb the fuel gas and the fuel vapor may be released into the atmosphere.

Therefore, if the fuel vapor can be processed in accordance with the predicted future running conditions of a motor vehicle, not only the absorbing capacity of the canister can be reduced but also the durability thereof can be improved.

The present invention is accomplished to solve the aforementioned problems of the prior art.

SUMMARY OF THE INVENTION

Accordingly, an object of the present invention is to provide an evaporated fuel processing apparatus for an internal combustion engine, which can optimally process fuel vapor according to a navigating information or the like.

According to the present invention, there is provided an evaporated fuel processing apparatus for an internal combustion engine, comprising: a purge pipe for leading fuel vapor generated from a fuel tank; a purge valve provided in the purge pipe for controlling an amount of the fuel vapor to be purged into the intake pipe; running condition detecting means for detecting a future running condition of the motor vehicle; an amount of generated fuel vapor predicting means for predicting an amount of fuel vapor evaporated from the fuel tank in accordance with the future running condition detected bog said running-condition detecting means; and a valve opening controlling means for controlling a future valve opening of said purge valve in accordance with the amount of fuel vapor predicted by said amount of generated fuel vapor predicting means.

According to this apparatus, the amount of generated fuel vapor is predicted in accordance with the future running conditions obtained from a navigation system and an information acquiring means for acquiring information concerning the traffic condition by communicating with information sources (thereinafter, a vehicle information and communication system). Further, the purge valve opening is controlled in accordance with the predicted amount of generated fuel vapor.

BRIEF DESCRIPTION OF THE DRAWINGS

Other features, objects and advantages of the present invention will become apparent from the following description of a preferred embodiment with reference to the drawings in which like reference characters designate like or corresponding parts throughout several views, and in which.

DETAILED DESCRIPTION OF THE PREFERRED EMBODIMENT

Hereinafter, the preferred embodiment of the present invention will be described in detail by referring to the accompanying drawings.

Figure 1:
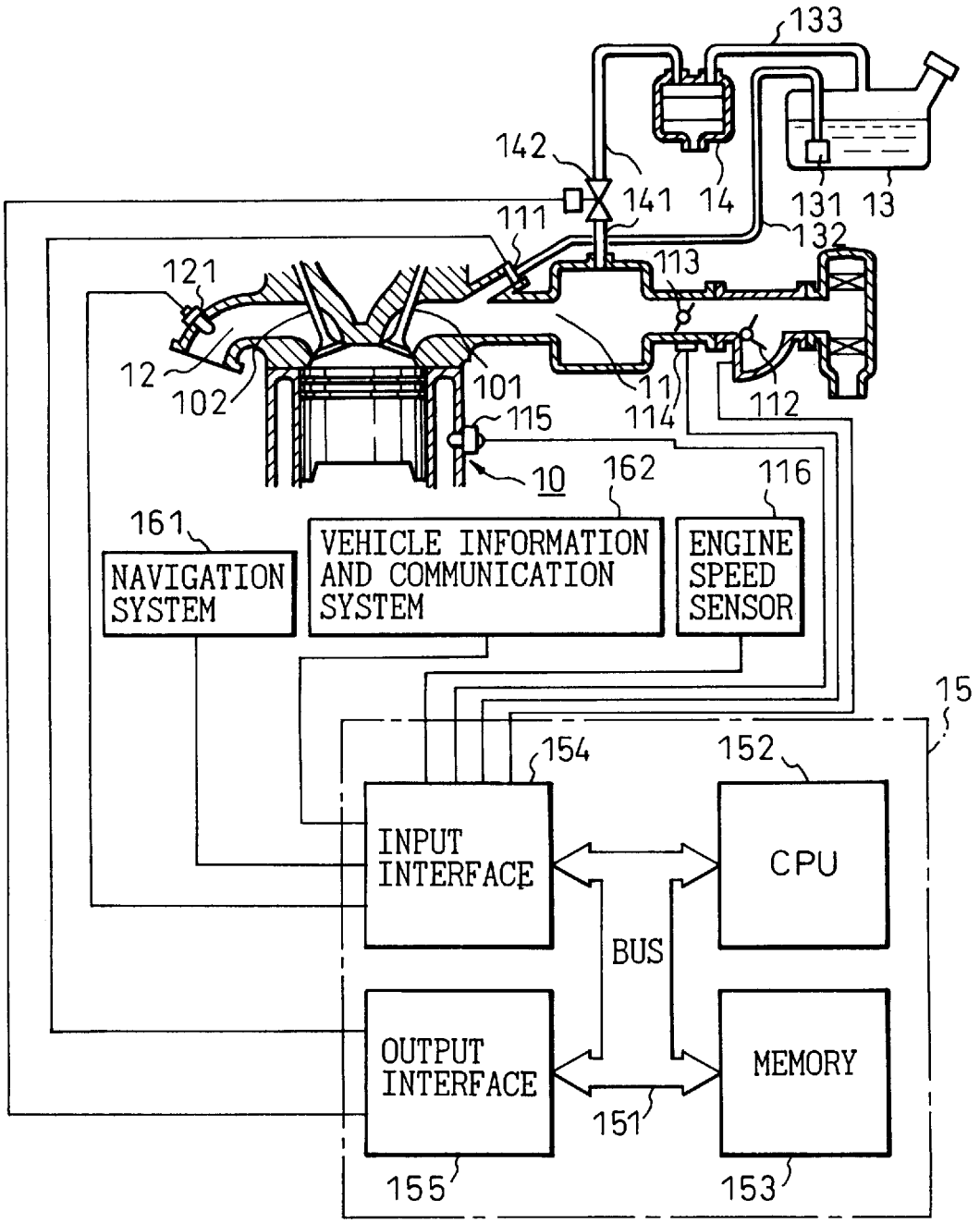
FIG. 1 is a diagram illustrating the configuration of an evaporated fuel processing apparatus embodying the present invention.

FIG. 1 is a diagram illustrating the configuration of an evaporated fuel processing apparatus embodying the present invention, namely, the preferred embodiment of the present invention. An intake pipe 11 is connected to one cylinder 10 of a multi-cylinder internal combustion engine through an intake valve 101, and an exhaust tube 12 is also connected thereto through an exhaust valve 12.

Further, a fuel injection valve 111 is placed at the intake pipe 11 in the vicinity of the intake valve 101 and injects fuel, which is stored in a fuel tank 13 and is pressurized by a fuel pump 131, into the intake air to thereby supply the fuel to the cylinder 10.

Incidentally, an air flow meter 112 for detecting intake air flow rate is placed at the upstream side of a throttle valve 113 arranged in the intake pipe 11.

Fuel vapor generated from the fuel tank 13 is led to a canister 14 through a vapor pipe 133. The canister 14 is connected to the intake pipe 11 through a purge pipe 141, in which a purge control valve 142 is arranged.

Moreover, an air-fuel ratio sensor 121 for detecting the concentration of residual oxygen in an exhaust gas, a throttle valve opening sensor 114 for detecting the opening of a throttle valve 113, a water temperature sensor 115 for detecting a coolant temperature, and an engine-speed sensor 116 for detecting the engine speed of the internal combustion engine are mounted on the engine.

The evaporated fuel processing apparatus according to the present invention, is controlled by a control system 15 which is configured as, for instance, a microcomputer system.

Namely, a control system 15 is composed of a bus 151, a central processing unit (CPU) 152, a memory 153 consisting of a random access memory (RAM) and a read-only memory (ROM), an input interface 154, and an output interface 155.

The input interface 154 is connected with the air flow meter 112, the throttle valve opening sensor 114, the water temperature sensor 115, the engine speed sensor 116 and the air-fuel ratio sensor 121, and is further connected with a navigation system 161 for instructing a driver in a route to a destination and with a vehicle information and communication system 162 for receiving weather information and traffic information.

Moreover, the output interface 155 is connected with the fuel injection valve 111 and the purge control valve 142.

According to the evaporated fuel processing apparatus having the aforementioned configuration, fuel vapor generated from the fuel tank 13 is once adsorbed in the canister 14. Because the negative pressure in the intake pipe 11 is introduced into the canister 14, when the purge control valve 142 is opened, the fuel vapor adsorbed in the canister 14 is led to the intake pipe 11 through the purge pipe 141 and is used in the cylinder 10 as fuel, together with fuel injected from the fuel injection valve 111.

Incidentally, in order to control the air-fuel ratio of the exhaust gas within a so-called "purification window" of a catalyst, an opening period of the fuel injection valve 111 is determined in accordance with the concentration of residual oxygen in the exhaust gas, which is measured by the air-fuel ratio sensor 121.

Figure 2:
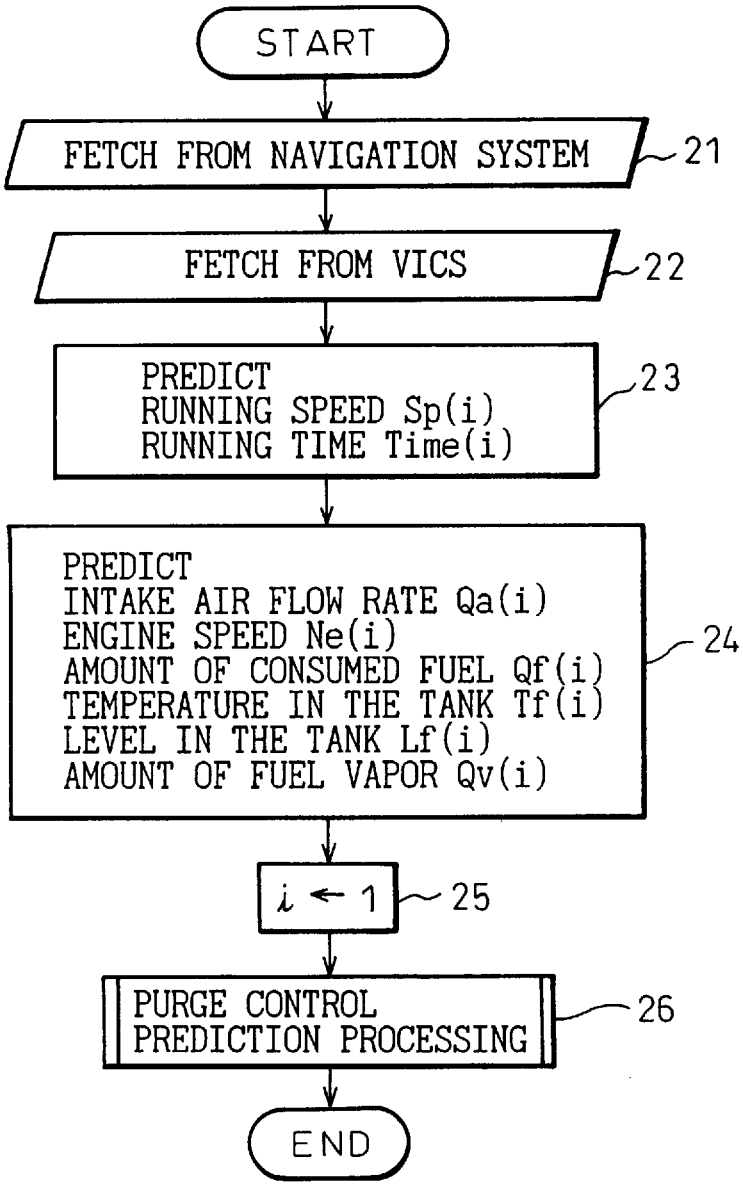
FIG. 2 is a flowchart of a predicting routine.

FIG. 2 is a flowchart of a predicting routine to be executed in the control system 15. A purge schedule for a day, that is, amounts of purged fuel vapor corresponding to each of running sections are predicted by executing the predicting routine before starting a motor vehicle.

At step 21, variables representing subsequent running conditions obtained from the navigation system 161 are fetched.

Namely, a running distance L(i), a speed limit SL(i), a running height H(i) and a slope TI(i) (i=) 1, . . . , N) corresponding to each of the running sections which are obtained by dividing the route outputted from the navigation system 161 into N sections.

At step 22, information concerning the route obtained from the vehicle information and communication system 162, for example, traffic information J(i), weather information C(i) and atmospheric temperature information Ta(i) etc. corresponding to each of the running sections i are fetched.

At step 23, the running speed SP(i) and the running time Time(i) are predicted in accordance with not only speed limit SL(i), the traffic-jam information J(i), and the weather information C(i) but also a driver's habit corresponding to each of the running sections i.

At step 24, an intake air flow rate Qa(i), an engine speed Ne(i), an amount of consumed fuel Qf(i), a temperature in a fuel tank Tf(i), a fuel level in the fuel tank Lf(i) and an amount of generated fuel vapor Qv(i) are predicted in accordance with the running distance L(i), the running height H(i), the slope TI(i) and the running speed SP(i) correspondingly to each of the running sections i.

Note, the temperature in the fuel tank Tf(i) can be defined as a function of the temperature corresponding to the precedent running section Tf(i−1), the atmospheric temperature Ta(i), the running speed SP(i) and the intake air flow rate Qa(i) as follows, $$Tf(i)=F\{Tf(i-1),\ Ta(i),\ SP(i),\ Qa(i)\}$$

Further, a generated fuel vapor Qv(i) is determined. as a function of the temperature in the fuel tank Tf(i-1), the atmospheric temperature Ta(i), the running speed SP(i), and the intake air flow rate Qa(i).

$$Qv(i)=G\{Tf(i-1),\ Lf(i),\ H(i)\}$$

Next, at step 25, the index "i" representing a running section is initialized to "1" and this routine is terminated after the purge control prediction subroutine is executed at step 26.

Figure 3:
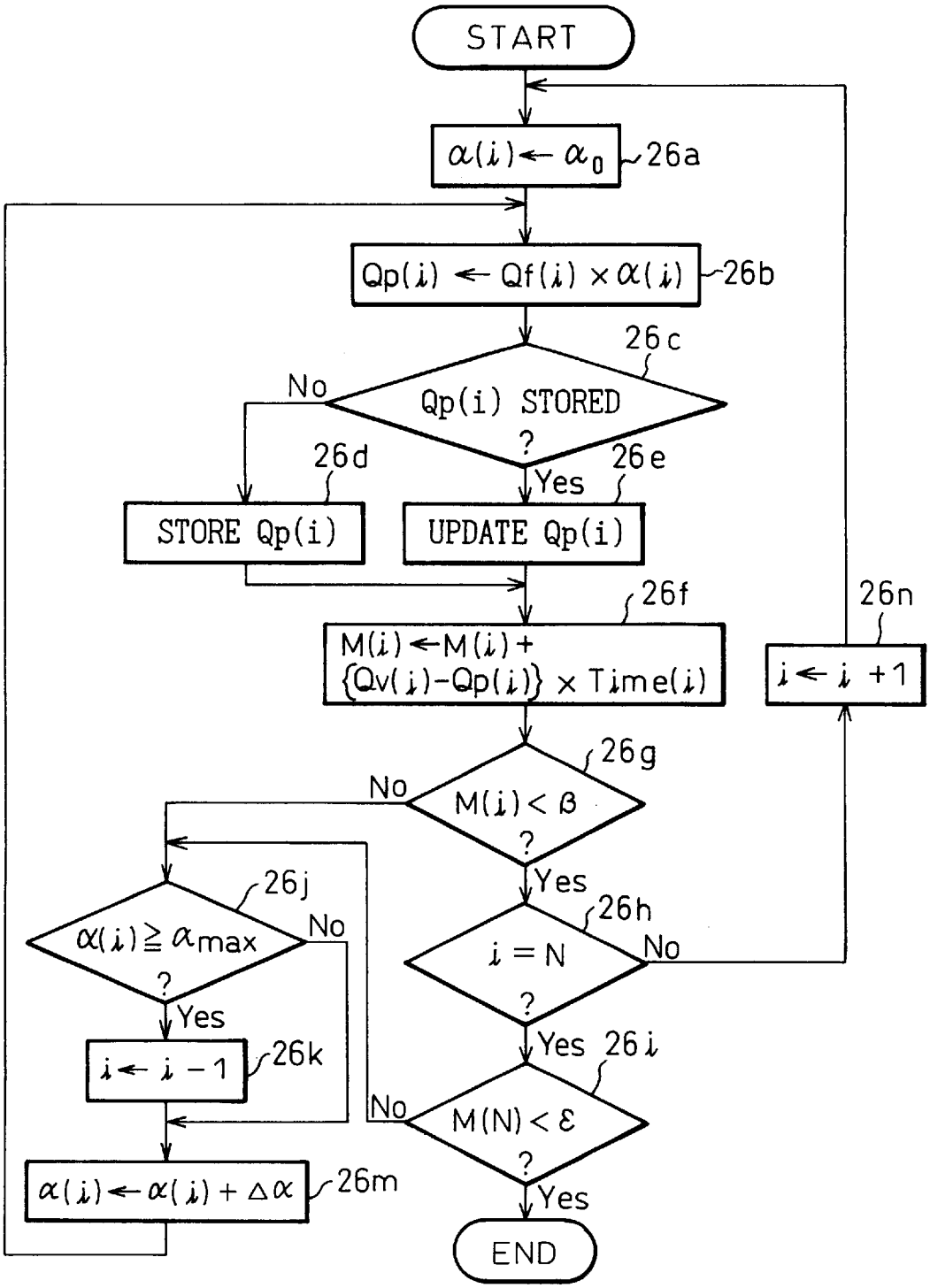
FIG. 3 is a purge control prediction processing routine.

FIG. 3 is a flowchart of the purge control prediction processing subroutine executed at step 26. At step 26*a*, a purge rate α(i) corresponding to the running section i is set at an initial value $\alpha_0$. Where, the purge rate α(i) is a rate of the amount of fuel purged from the canister 14 to the amount of consumed fuel Qf(i). The initial value $\alpha_0$ is determined in such a way that the purged fuel does not seriously affect the air-fuel ratio.

At step 26*b*, an amount of purged fuel Qp(i) is obtained by multiplying the quantity of consumed fuel Qf(i) by the purge rate α(i)

$$Qp(i)=Qf(i)\times\alpha(i)$$

At step 26*c*, it is determined whether or not the amount of purged fuel Qp(i) has been already stored in the RAM. If the determination is negative, the amount of purged fuel Qp(i) is newly stored at step 26*d*. Conversely, if the determination is affirmative at step 26*c*, the amount of purged fuel Qp(i) is renewed at. step 26*e*.

At step 26*f*, an amount of fuel adsorbed in the canister 14 M(i) is renewed by integrating the difference between the amount of generated fuel vapor Qv(i) and the amount of purged fuel gas Qp(i). Namely, $$M(i)=M(i)+\{Qv(i)-Qp(i)\}\times\mathrm{Time}(i)$$

At step 26*g*, it is determined whether or not the amount of fuel adsorbed in the canister M(i) is less than a predetermined fixed value β. If the determination is affirmative, the control proceeds to step 26*h*.

At step 26*h*, it is determined whether or not the purge control predictions for all of the running sections have been completed. If it is determined that the predictions have been completed, the control proceeds to step 26*i* where the amount of fuel adsorbed in the canister at the completion of the running of the day M(N) is less than a predetermined fixed amount ε.

If the determination at step 26*i* is affirmative, that is, if the amount of fuel adsorbed in the canister at the completion of the running of the day M(N) is not more than the predetermined amount $\epsilon$, this subroutine is terminated.

Note, the reason for restraining the amount of fuel adsorbed in the canister at the completion of the running of the day to less than the predetermined amount $\epsilon$ is to prevent the canister 14 from being deteriorated due to the adhesion of the fuel vapor to activated carbon contained in the canister 14 if the absorbed fuel is left in the canister 14 for a long time.

When the determination at step 26*g* is negative, that is, when the amount of fuel adsorbed in the canister M(i) is not less than the predetermined upper limit value $\beta$, and when the determination at step 26*i* is negative, that is, when the amount of fuel adsorbed in the canister at the completion of the running for the day M(N) is not less than the predetermined amount $\epsilon$, the control proceeds to step 26*j*.

At step 26*j*, it is determined whether or not the purge rate $\alpha(i)$ corresponding to the running section i is not less than the maximum purge rate $\alpha_{max}$. Note, the maximum purge rate $\alpha_{max}$ is determined as a maximum rate of the amount of fuel purged from the canister to the amount of fuel injected from the fuel injection valve, over which the accuracy of the air-fuel ratio control is deteriorated.

Therefore, if the determination at step 26*j* is affirmative, as it is determined that the amount of purged fuel vapor cannot be increased in the running section i, the index i is decremented by 1 so as to increase the amount of fuel gas purged in the previous running section. Then, the control proceeds to step 26*m*.

Conversely, if the determination at step 26*j* is negative, it is determined that the amount of purged fuel vapor can be increased at the running section i, and thee control proceeds directly to step 26*m*.

After the purge rate $\alpha(i)$ is increased by a predetermined fixed amount $\Delta\alpha$ using a following equation at step 26*m*, the control returns to step 26*b*.

$$\alpha(i)=\alpha(i)+\Delta\alpha$$

If the determination at step 26*h* is negative, that is, if the purge control predictions are not completed for all of the running sections, the control proceeds to step 26*n* where the index i is incremented. Then, the control returns to step 26*a*.

By executing this routine, the amount of purged fuel gas at each of the running sections is predicted according to future driving conditions and, further, a purge schedule is determined.

Figure 4:
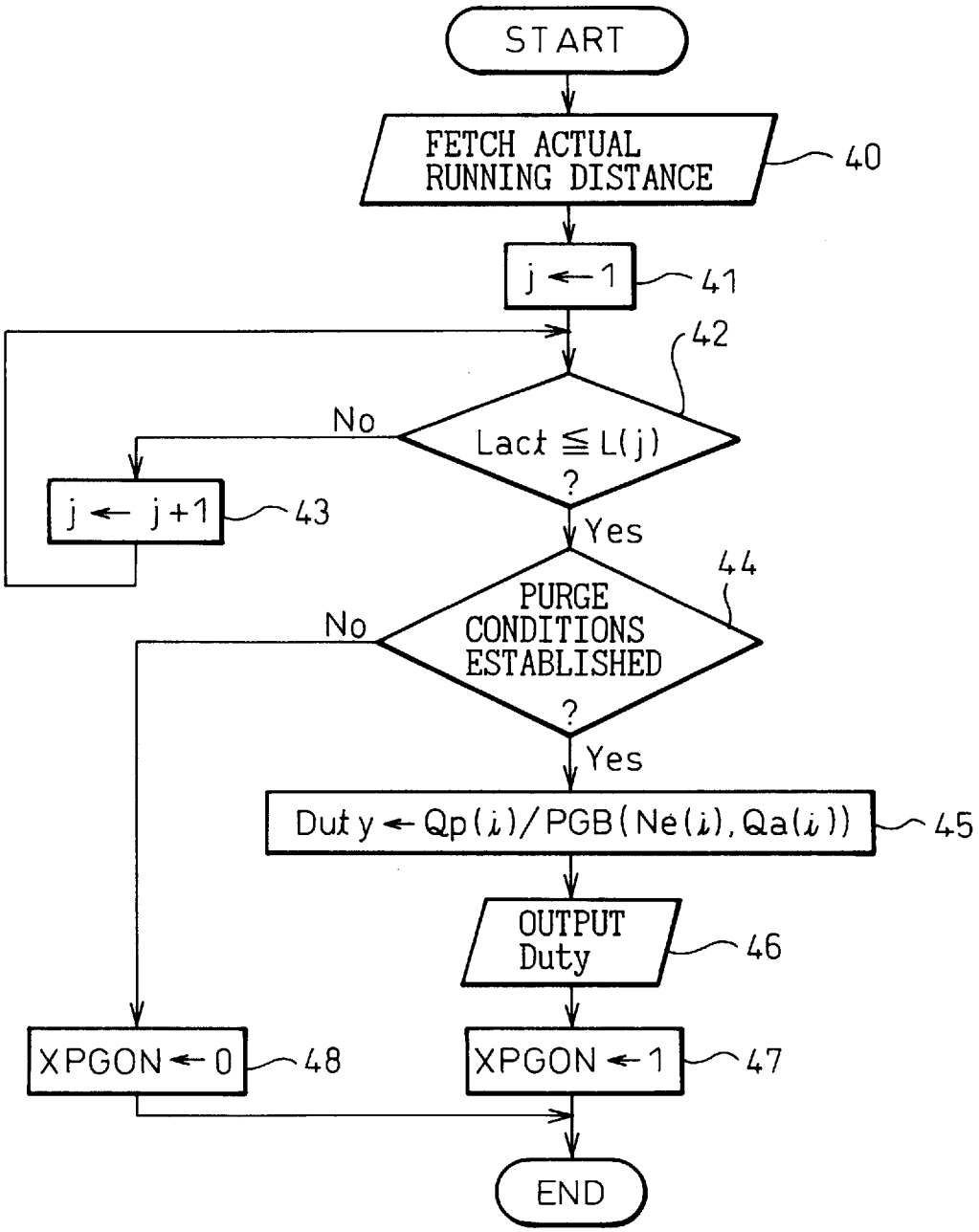
FIG. 4 is a flowchart of a purge executing routine.

FIG. 4 is a flowchart of a purge executing routine for executing the purge in accordance with the purge schedule. This routine is executed every predetermined interval.

Namely, in step 40, an actual running distance $L_{act}$ for the day is fetched from, for example, the navigation system 161.

In step 41, the index j representing the running section is set at an initial value, that is "1".

In step 42, it is determined whether or not the actual running distance $L_{act}$ is not less than the running distance L(i).

If the determination at step 42 is negative, that is, if the actual running distance $L_{act}$ is not less than the running distance L(i), the control proceeds to step 43 where the index j is incremented. Then, the control returns to step 42.

If the determination at step 42 is affirmative, that is, if the actual running distance $L_{act}$ is not more than the running distance L(i), the control proceeds to step 44 where it is determined whether or not the purge executing condition is established.

Note, the purge executing condition is, for example, that an air-fuel ratio feedback control is being performed and that the temperature THW of cooling water for cooling the internal combustion engine is higher than a predetermined temperature (for instance, 50 degrees centigrade).

If the determination at step 44 is affirmative, the control proceeds to step 45 where a duty ratio Duty is calculated according to the following equation by using the engine speed Ne(i) corresponding to the running section i, the intake air flow rate Qa(i) and the amount of purged fuel vapor Qp(i), $$Duty=Qp(I)/PGB(Ne(i), Qa(i))$$

where PGB designates a full purge flow rate (namely, a purge flow rate at the full opening the purge control valve) that is determined as a function of the engine speed Ne(i) and the intake air flow rate Qa(i).

At step 46, the duty ratio Duty is outputted. Subsequently, at step 47, a purge implementing flag XPGON is set to "1". Then, this routine is terminated.

Conversely, if the determination at step 44 is negative, a purge operation is not performed. Subsequently, at step 49, the purge executing flag XPGON is set at a value of "0". Then, this routine is terminated.

Figure 5:
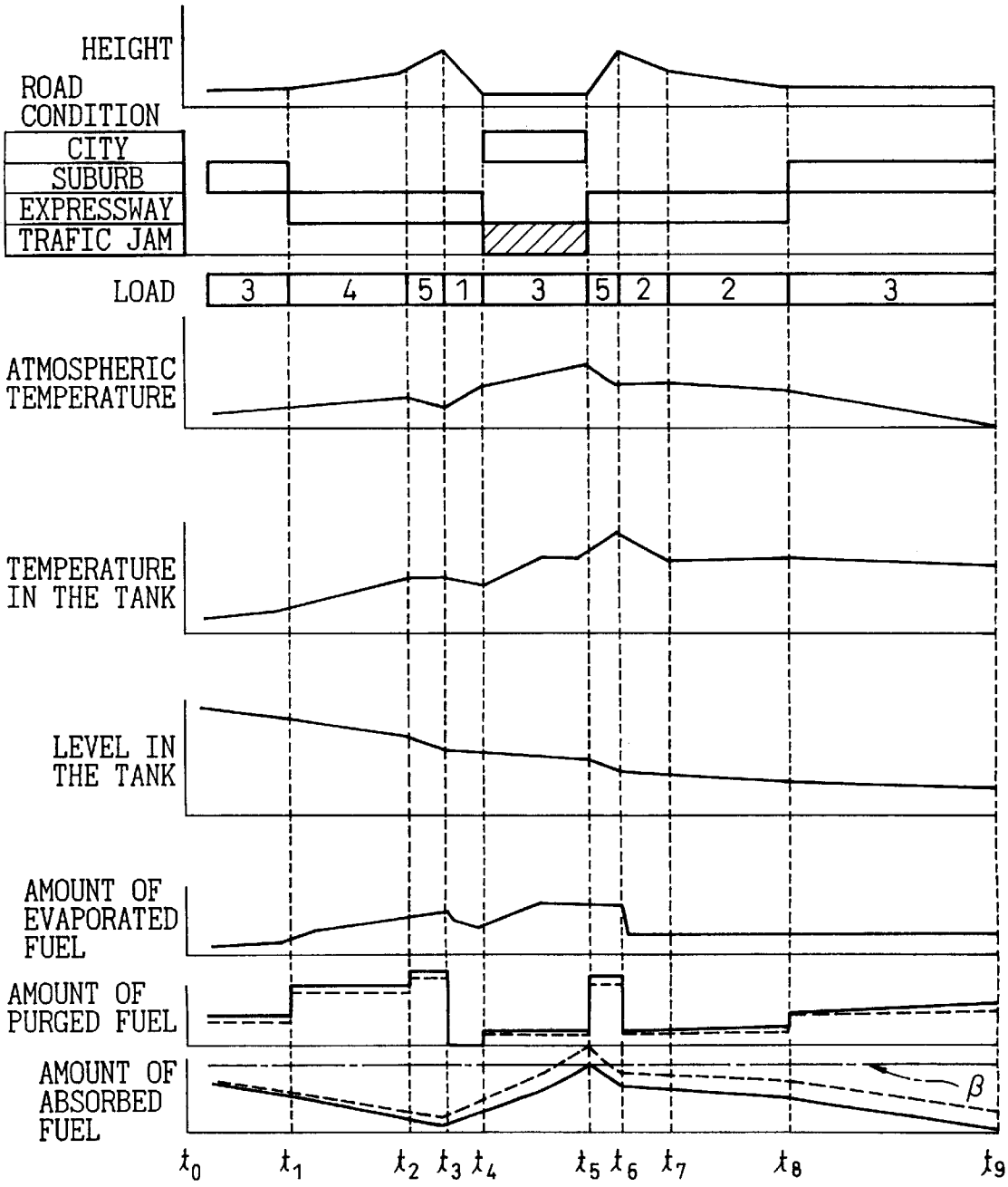
FIG. 5 is a diagram illustrating the effects of the evaporated fuel processing apparatus of the present invention.

FIG. 5 is a diagram showing effects of the evaporative fuel processing apparatus of the present invention. In this figure, the abscissa represents time.

Namely, information concerning the running height and the road conditions is obtained from the navigation system. The motor vehicle runs in a suburb from $t_0$ to $t_1$, on an expressway from $t_1$ to $t_4$, in a street from $t_4$ to $t_5$, on the expressway again from $t_5$ to $t_8$ and in a suburb during a further time period between $t_8$ and $t_9$.

Information concerning traffic and atmospheric temperature is obtained from a vehicle information and communication system. Further, an occurrence of a traffic jam between the moments $t_4$ and $t_5$ is predicted.

Moreover, the load (that is, an intake air flow rate), a temperature in the tank, the fuel level in the tank and the amount of fuel vapor can be predicted from the information described hereinabove. Furthermore, the amount of purged fuel vapor and the amount of fuel adsorbed in the canister are also predicted. Note, the larger the load value becomes, the higher the load becomes.

Namely, when the motor vehicle runs on an ascending expressway from $t_1$ to $t_3$, the amount of the fuel vapor absorbed in the canister becomes small because the amount of the fuel vapor purged from the canister is controlled to increase though the amount of the fuel vapor generated from the fuel tank becomes large due to an increase in the fuel temperature.

Conversely, when the motor vehicle runs into a traffic jam in a city from $t_4$ to $t_5$, the amount of the purged fuel vapor becomes small because the atmospheric temperature rises due to many low-speed vehicles around the motor vehicle and the cooling power of the wind is reduced.

When the amount of purged fuel vapor is controlled according to the current load of the engine by the conventional evaporated fuel processing apparatus, the amount of purged fuel vapor is restrained at a low level as indicated by a broken lines. At $t_5$, the amount of the fuel vapor adsorbed in the canister exceeds an upper limit $\beta$, so that the emission of the exhaust gas is degraded.

Conversely, by the evaporated fuel processing apparatus according to the invention, the amount of the fuel vapor purged from the canister can be reduced because it is controlled so that it does not exceed the upper limit $\beta$ at any time by the amount of the fuel vapor before $t_5$ is increased as shown by a solid line in accordance with the predicted amount of the fuel vapor generated from the fuel tank by running in a city.

According to the prior art, there is the possibility that fuel vapor, which is not purged, is left in the canister after the running for the day and that the absorbing power of the canister is deteriorated. Conversely, according to the present invention, the deterioration of the canister can be restrained because all of the fuel vapor absorbed in the canister can be intentionally purged at the end of the running of the day to purge the fuel vapor in accordance with the predicted amount of the fuel vapor generated from the tank.

In accordance with the aforementioned embodiment, an optimal purge control can be performed as long as actual operating variables at the end of the running agree with the predicted operating variables. However, the disagreement between the actual operating variables and operating variables predicted before starting is frequently caused by, for instance, an accidental traffic jam or a change of the running route. After determining whether or not the actual running variables disagree with the predicted operating variables, a reprediction of the operating variables may be needed.

Figure 6:
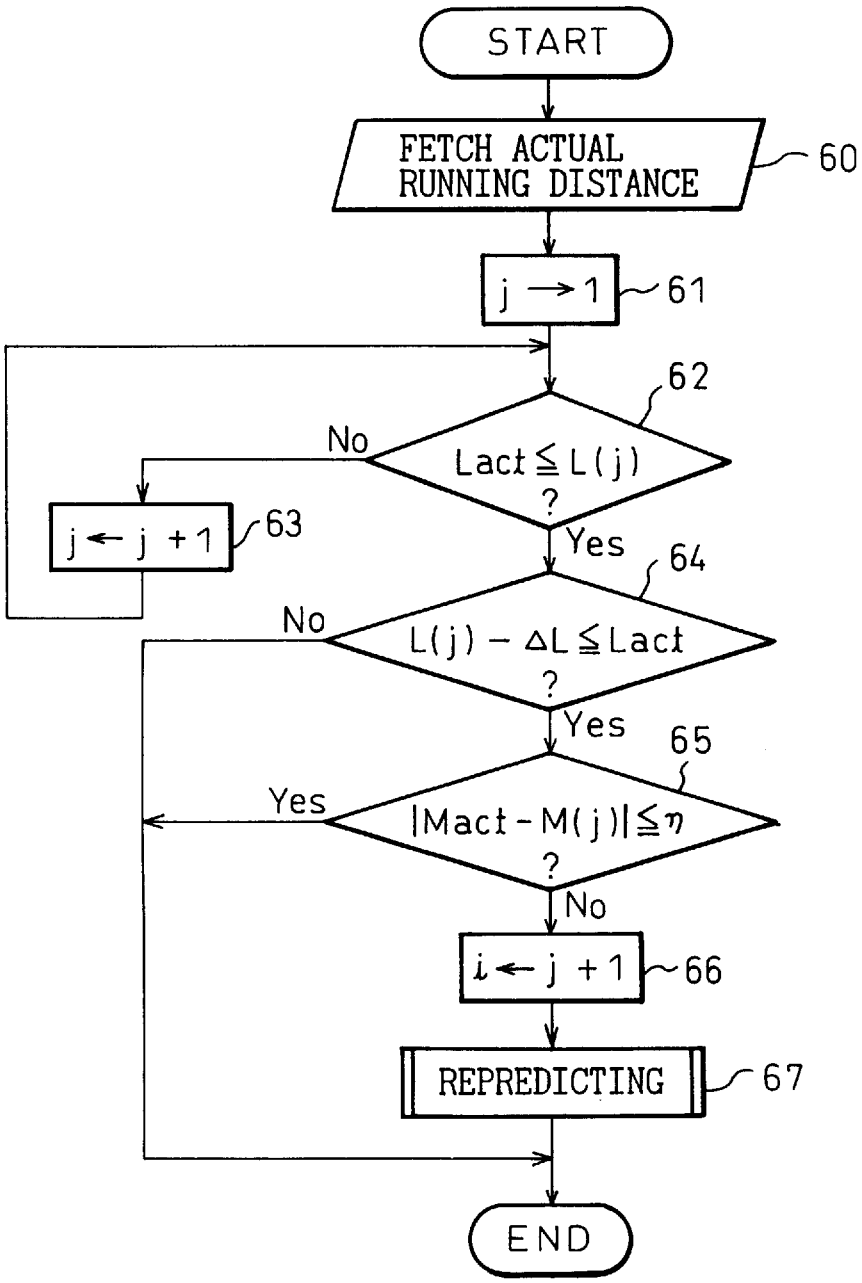
FIG. 6 is a flowchart of a repredicting routine.

FIG. 6 is a flowchart of a repredicting routine executed every regular interval after starting.

Namely, at step 60, the actual running distance $L_{act}$ is read from a trip meter or the like of a motor vehicle.

At step 61, the index j indicating the running section is set to an initial value "1".

At step 62, it is determined whether or not the actual running distance $L_{act}$ is not more than the predicted running distance L(i).

If the determination at step 62 is negative, that is, if the actual running distance $L_{act}$ is longer than the running distance L(i), the control proceeds to step 63 where the index j is incremented. Then, the control returns to step 62.

If the determination at step 62 is affirmative, that is, if the actual running distance $L_{act}$ is not longer than the predicted running distance L(i), the control proceeds to step 64 where it is determined whether or not the actual running distance is shorter than the predicted running distance L(j) subtracted by a fixed distance ΔL, that is, (L(j)−ΔL).

If the determination at step 64 is affirmative, that is, if the actual running distance $L_{act}$ is within a predetermined range, the control proceeds to step 65 where it is determined whether or not the absolute value of the difference between the amount of the fuel vapor actually adsorbed in the canister and the predicted amount of the adsorbed fuel vapor M(j) is larger than a fixed allowable error η.

If the determination at step 64 is negative, that is, if the actual running distance $L_{act}$ is not in the predetermined range and if the determination at step 65 is affirmative, that is, if the absolute value of the difference between the amount of the fuel vapor actually adsorbed in the canister and the predicted amount of the adsorbed fuel vapor M(j) is less than the allowable error η, this routine is directly terminated without executing reprediction.

If the determination at step 65 is negative, that is, if the absolute value of the difference between the amount of the fuel vapor actually adsorbed in the canister and the predicted amount of the adsorbed fuel vapor M(j) is more than the allowable error η, the control proceeds to step 66 where an index corresponding to the running section which needs the reprediction is set to (j+1). This routine is terminated after the reprediction is executed at step 67.

Note, the explanation about the reprediction routine is omitted because this routine is identical with the purge control prediction processing routine shown in FIG. 3.

Incidentally, not only the amount of the generated fuel vapor cannot be actually measured, but also the amount of fuel vapor actually adsorbed in the canister $M_{act}$ cannot be measured. Therefore, the amount of the fuel vapor adsorbed in the canister $M_{act}$ is estimated based on a fuel-vapor concentration learning factor FGPG.

Note, the fuel vapor concentration learning factor FGPG is calculated according to a moving average of an air-fuel correction factor FAF calculated in an air-fuel ratio control routine.

Hereinafter, the procedure for calculating the fuel vapor concentration learning factor will be described. At first, an air-fuel ratio control routine will be described hereinbelow.

Figure 7:
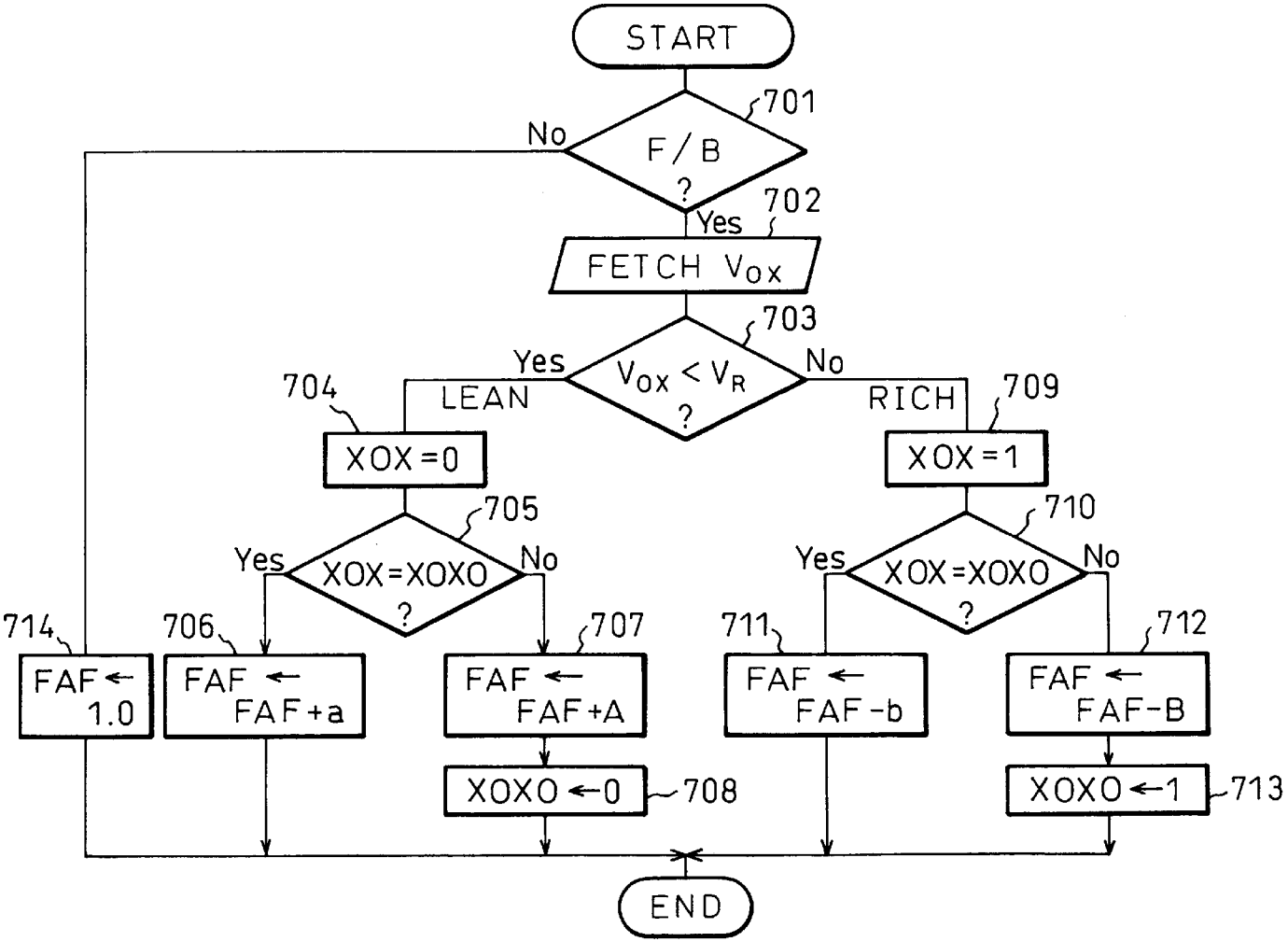
FIG. 7 is a flowchart of an air-fuel ratio control routine.

FIG. 7 is a flowchart of an air-fuel ratio control routine executed during actually running. This program is executed every fixed interval.

At step 701, it is determined whether or not an air-fuel ratio feedback control is allowed. Namely, an air-fuel ratio feedback control is permitted when all of the following conditions are established, (1) The engine is not in the cranking state.

(2) Fuel is not being cut. It is not a time during which fuel is cut.

(3) Temperature of cooling water THW≧80 degrees centigrade.

(4) The air-fuel ratio sensor is activated.

When any one of these conditions is not established, the air-fuel ratio feedback control is prohibited.

If the determination at step 701 is affirmative, an output voltage of $V_{ox}$ of an air-fuel ratio sensor 121 is fetched at step 702. At step 703, it is determined whether or not the output voltage $V_{ox}$ is lower than a fixed reference voltage $V_R$ (for example, 0.45 V).

If the determination at step 703 is affirmative, it is decided that the air-fuel ratio of the exhaust gas is lean. Then, the control proceeds to step 704 where the air-fuel ratio flag XOX is set to "0".

At step 705, it is determined whether or not the air-fuel ratio flag XOX agrees with a state maintaining flag XOXO.

If the determination at step 705 is affirmative, it is decided that the lean state is maintained, and the air-fuel ratio correction factor FAF is increased by a lean integral constant "a" at step 706. Then, this routine is terminated.

If the determination at step 705 is negative, it is decided that the air-fuel ratio changes from a rich state to a lean state. Thus, at step 707, the air-fuel ratio correction factor FAF is increased by a lean skip constant "A". This routine is terminated after the state maintaining flag XOXO is reset at step 708. Note, the lean skip amount "A" is set much larger than the lean integral amount "a".

If the determination at step 703 is negative, it is decided that the air-fuel ratio of the exhaust gas is rich, and the control proceeds to step 709 where the air-fuel ratio flag XOX is set to "1".

At step 710, it is determined whether or not the air-fuel ratio flag XOX agrees with the state maintaining flag XOXO.

If the determination at step 710 is affirmative, it is decided that the rich state is to be maintained. This routine is terminated after the air-fuel ratio correction factor FAF is reduced by a rich integral constant "b" at step 711.

If the determination at step 710 is negative, it is decided that the state changes from the lean state to the rich state. Thus, at step 712, the air-fuel ratio correction factor FAF is reduced by subtracting the lean skip constant "B" therefrom. Then, this routine is terminated after the state maintaining flag XOXO is set to "1". The rich skip constant "B" is set much larger than the rich integral constant "b".

If the determination at step 701 is negative, that is, if the air-fuel ratio feedback control is prohibited, the air-fuel ratio correction factor FAF is set to "1.0" at step 714. Then, this routine is terminated.

Figure 8:
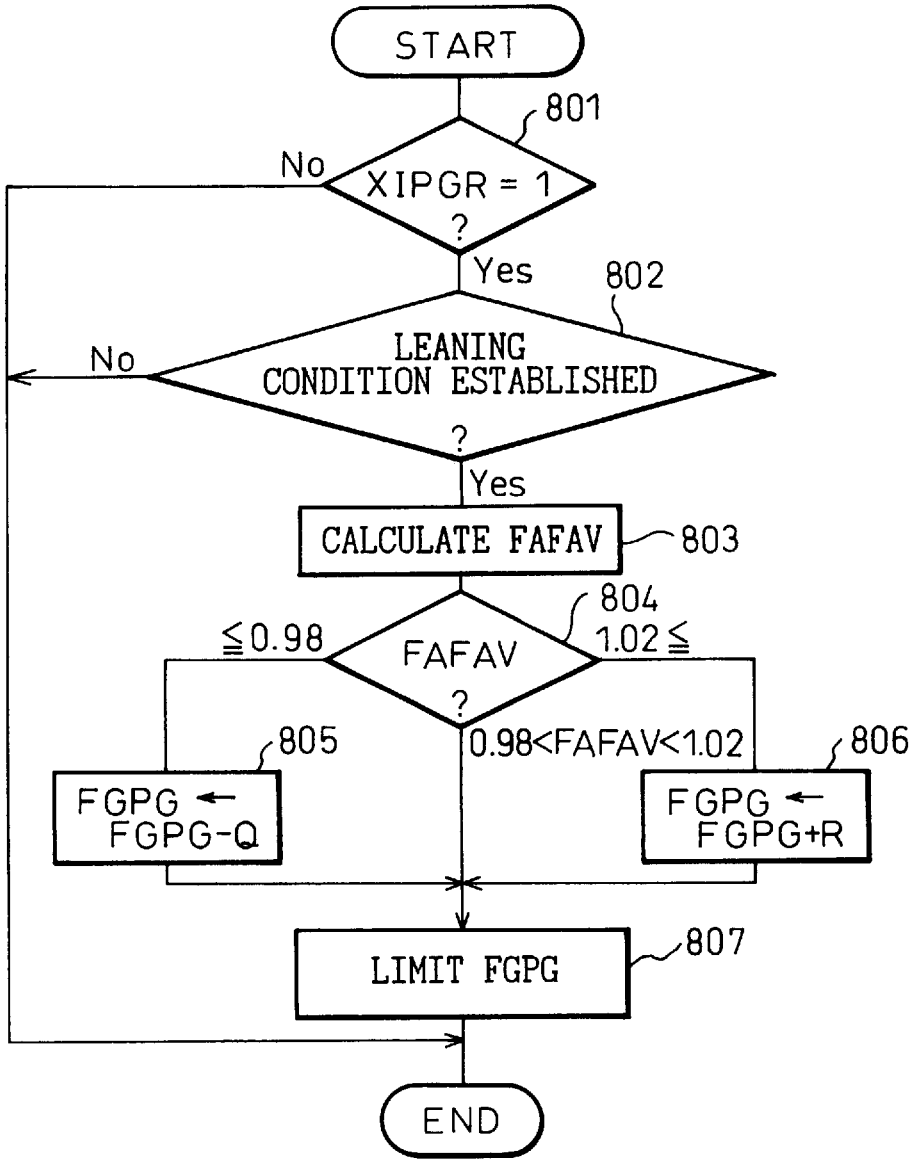
FIG. 8 is a flowchart of a fuel vapor concentration learning routine.

FIG. 8 is a flowchart of a fuel vapor concentration learning routine for calculating FGPG based on FAF. At step 801, it is determined whether or not the purge executing flag XIPGR is "1", that is, whether or not a purge is performed. If the determination at step 703 is negative, it is decided that a purge is prohibited, and this routine is directly terminated.

If the determination at step 801 is affirmative, that is, if a purge is performed, the control proceeds to step 802 where it is determined whether or not the following concentration learning conditions are established. Namely, (1) The air-fuel ratio feedback control is being performed.

(2) Temperature of cooling water≧80 degrees centigrade.

(3) An increased fuel for start=0.

(4) An increased fuel for warm-up=0.

If all of these conditions are established, it is decided that the concentration learning is to be performed, and the control proceeds to step 803. If one of these conditions are not established, this routine is terminated without learning the concentration.

At step 803, the moving average FAFAV of the air-fuel ratio correction factor FAF is calculated, and the fuel gas concentration is learned in accordance with the moving average of the air-fuel ratio correction factor at step 804.

Namely, if the moving average value FAFAV is smaller than 0.98, the control proceeds to step 805 where the learning factor FGPG is updated by reducing the fuel gas concentration learning factor FGPG by subtracting a predetermined value Q therefrom.

If the moving average FAFAV is larger than 1.02, the control proceeds to step 806 where the learning value FGPG is updated by adding a predetermined value R to the fuel gas concentration learning factor FGPG, and the control proceeds to step 807.

If the moving average FAFAV is larger than 0.98 and smaller than 1.02, the control proceeds to step 807 without updating the learning factor FGPG.

At step 807, the fuel gas concentration learning factor FGPG is limited within a range between a lower limit value (for example, 0.7) and an upper limit value (for example, 1.3). Then, this routine is terminated.

Figure 9:
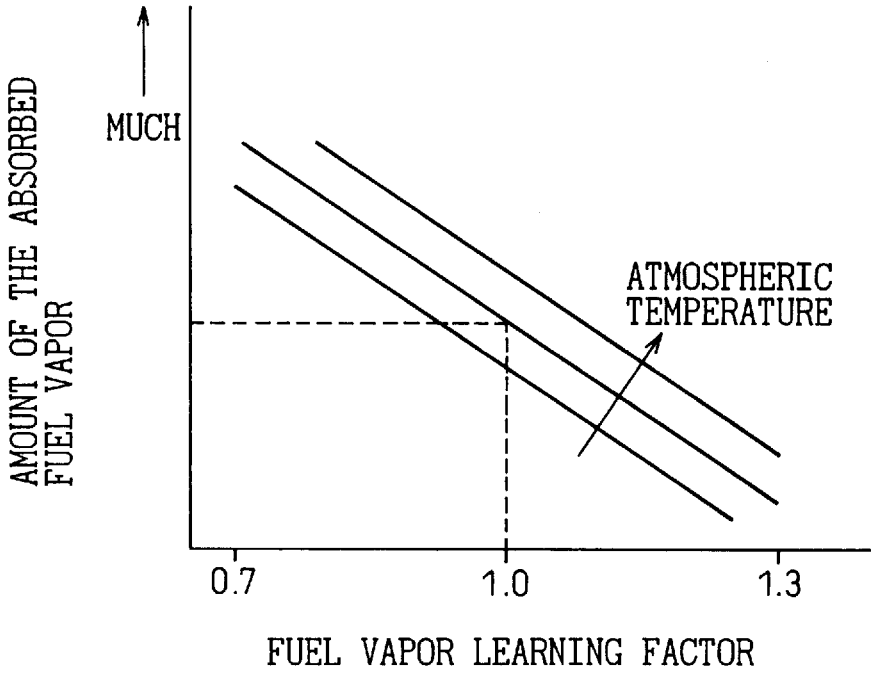
FIG. 9 is a graph illustrating the relationship between a fuel vapor concentration learning value and an amount of fuel adsorbed in a canister.

FIG. 9 is a graph illustrating the relationship between the fuel gas concentration learning value FGPG and the amount of the fuel vapor adsorbed in the canister. The abscissa denotes the fuel gas concentration learning value FGPG; and the ordinate denotes the amount of the fuel vapor adsorbed in the canister. Note, a parameter is an atmospheric temperature.

Namely, when the fuel gas concentration learning factor FGPG is smaller than "1.0" at a standard temperature, it is determined that the air-fuel ratio deviates to a rich side, that is, the amount of the fuel vapor adsorbed in the canister is small because high concentration fuel vapor has been purged.

Conversely, when the fuel gas concentration learning factor FGPG is larger than "1.0", it is determined that the air-fuel ratio deviates to a lean side, that is, the amount of the fuel vapor absorbed in the canister is large because low concentration fuel vapor has been purged.

Note, the higher the atmospheric temperature rises, the more the amount of the generated fuel gas becomes.

Namely, the amount $M_{act}$ of the fuel vapor actually adsorbed in the canister, which is used in step 65 of thus reprediction routine shown in FIG. 6, can be calculated as a function of the fuel vapor concentration learning value FGPG and the atmospheric temperature T by using the following equation.

$$M_{act}=M_{act}(FGPG, T)$$

Therefore, if the amount of the fuel vapor actually absorbed in the canister is calculated using the above-mentioned equation to use at step 65, and the reprediction is performed when the actual operating valuables disagree with the predicted operating valuables, it is possible optimally to control the amount of the purged fuel vapor.

Although the preferred embodiment of the present invention has been described above, it should be understood that the present invention is not limited thereto and that modifications will be apparent to those skilled in the art without departing from the spirit of the invention. For example, in the case of the aforementioned embodiment, the amount of purged fuel vapor is controlled by setting a predicted value every the running section. However, to improve the control accuracy, it may be controlled by setting the predicted value correspondingly to each of a plurality of points on a road according to latitude and longitude information and not to the running sections.

Further, the means for detecting the running conditions are not limited to the navigation system and the vehicle information and communication system. Devices, apparatuses and systems for obtaining information from the surroundings of a motor vehicle, such as an automobile telephone and an optical communication system, may be employed as such means.

Moreover, although in the aforementioned embodiment: the reprediction is performed before the motor vehicle finishes running on a running section, the reprediction according to the present invention is not limited thereto. The purge-schedule accuracy can be improved by performing the reprediction when an accidental change of a route or a running section is detected, for example, when it is detected that the motor vehicle takes a route deviated from a planned route, or when it is detected that the motor vehicle does not reach to the next running section at a scheduled time.

The scope of the present invention, therefore, should be determined solely by the appended claims.

We claim:

1. An evaporated fuel processing apparatus for an internal combustion engine of a vehicle, comprising:

a purge pipe for leading fuel vapor generated from a fuel tank to an intake pipe;

a purge valve provided in the purge pipe for controlling an amount of fuel vapor to be purged into the intake pipe;

a running condition detecting means for detecting a future running condition of the engine based on information corresponding to a route over which the vehicle will be running;

an amount predicting means for predicting an amount of fuel vapor evaporated from the fuel tank in accordance with the future running condition detected by the running condition detecting means; and a valve opening controlling means for controlling a future valve opening of the purge valve in accordance with the amount of fuel vapor predicted by the amount predicting means.

2. An evaporated fuel processing according to claim 1, further comprising:

a canister installed in said purge pipe for absorbing fuel vapor.

3. An evaporated fuel processing apparatus according to claim 1, wherein:

the information corresponding to the route is obtained from a navigation system.

4. An evaporated fuel processing apparatus according to claim 1, wherein:

the information corresponding to the route is obtained from an information acquiring means for acquiring information concerning traffic conditions by communicating with information sources.

5. An evaporated fuel processing apparatus according to claim 1, wherein the information corresponds to at least one of road conditions, weather conditions and traffic conditions.

6. An evaporated fuel processing apparatus for an internal combustion engine of a vehicle, comprising:

a purge pipe for leading fuel vapor generated from a fuel tank to an intake pipe;

a purge valve provided in the purge pipe for controlling an amount of fuel vapor to be purged into the intake ripe;

a running condition detecting means for detecting a future running condition of the engine;

an amount predicting means for predicting an amount of fuel vapor evaporated from the fuel tank in accordance with the future running condition detected by the running condition detecting means;

a valve controlling means for controlling a future valve opening of the purge valve in accordance with the amount of the fuel vapor predicted by the amount predicting means;

an air-fuel ratio controlling means for controlling an air-fuel ratio of the engine at a target air-fuel ratio, wherein said amount predicting means predicts an amount of a fuel vapor evaporated from the fuel tank in accordance with an air-fuel ratio correcting factor used by the air-fuel ratio controlling means.

7. An evaporated fuel processing apparatus according to claim 6, further comprising:

repredicting means for repredicting an amount of fuel vapor evaporated from the fuel tank when an actual running condition deviates by more than a predetermined amount from the running condition predicted by the running condition detecting means.

8. An evaporated fuel processing apparatus according to claim 7, wherein:

the running condition detecting means detects the running condition based on information obtained from a navigation system.

9. An evaporated fuel processing apparatus according to claim 7, wherein:

the running condition detecting means detects the running condition based on information obtained from an information acquiring means for acquiring information concerning traffic conditions by communicating with information sources.

10. An evaporated fuel processing apparatus according to claim 6, wherein:

the running condition detecting means detects the running condition based on information obtained from a navigation system.

11. An evaporated fuel processing apparatus according to claim 6, wherein:

the running condition detecting means detects the running condition based on information obtained from an information acquiring means for acquiring information concerning traffic conditions by communicating with information sources.

12. An evaporated fuel processing apparatus for an internal combustion engine of a vehicle, comprising:

a purge pipe for leading fuel vapor generated from a fuel tank to an intake pipe;

a purge valve provided in the purge pipe for controlling an amount of fuel vapor to be purged into the intake pipe;

a running condition detecting means for detecting a future running condition of the engine;

an amount predicting means for predicting an amount of fuel vapor evaporated from the fuel tank in accordance with the future running condition detected by the running condition detecting means;

a valve controlling means for controlling a future valve opening of the purge valve in accordance with the amount of the fuel vapor predicted by the amount predicting means; and repredicting means for repredicting an amount of fuel vapor evaporated from the fuel tank when an actual running condition deviates by more than a predetermined amount from the running condition predicted by the running condition detecting means.

13. An evaporated fuel processing apparatus according to claim 12, wherein:

the running condition detecting means detects the running condition based on information obtained from a navigation system.

14. An evaporated fuel processing apparatus according to claim 12, wherein:

the running condition detecting means detects the running condition based on information obtained from an information acquiring means for acquiring information concerning traffic conditions by communicating with information sources.

15. An evaporated fuel processing method for processing fuel vapor evaporated from a fuel tank of an internal combustion engine of a vehicle, which provides a purge pipe which connects the fuel tank and an intake pipe for leading the fuel vapor and a purge valve installed in the purge pipe for controlling an amount of a fuel vapor to be purged into the intake pipe, comprising the steps of:

detecting a future running condition of the engine based on information corresponding to a route over which the vehicle will be running;

predicting an amount of fuel vapor evaporated from the fuel tank in accordance with the detected future running condition; and controlling a future valve opening of the purge valve in accordance with the predicted amount of fuel vapor.

16. An evaporated fuel processing method according to claim 15, further comprising the step of:

controlling an air-fuel ratio of the engine at a target air-fuel ratio, wherein said predicted amount of generated fuel is predicted based on an air-fuel ratio correcting factor used in controlling the air-fuel ratio.

17. An evaporated fuel processing method according to claim 15 or 16, wherein:

the information corresponding to the route is obtained from an information acquiring means for acquiring information concerning traffic conditions by communicating with information sources.

18. An evaporated fuel processing method according to claim 15, further comprising a step of:

repredicting an amount of fuel vapor evaporated from the fuel tank when an actual running condition deviates by more than a predetermined amount from the predicted running condition.

19. An evaporated fuel processing method according to claim 18, wherein:

the information corresponding to the route is obtained from a navigation system.

20. An evaporated fuel processing method according to claim 18, wherein:

the information corresponding to the route is obtained from an information acquiring means for acquiring information concerning traffic conditions by communicating with information sources.

21. An evaporated fuel processing method according to claim 15, wherein:

the information corresponding to the route is obtained from a navigation system.

22. An evaporated fuel processing method according to claim 15, wherein the information corresponds to at least one of road conditions, weather conditions and traffic conditions.

* * * * *

UNITED STATES PATENT AND TRADEMARK OFFICE

CERTIFICATE OF CORRECTION

PATENT NO. : 5,836,291

DATED : November 17, 1998

INVENTOR(S) : Yukio KINUGASA, et al.

It is certified that error appears in the above-identified patent and that said Letters Patent is hereby corrected as shown below:

Column 1, line 26, delete the colon after "tank".

Column 2, line 11, change "bog" to --by--.

Column 3, line 59, change "(i=)1," to --(i=1,--.

Column 9, line 66, change "thus" to --the--.

Column 10, line 30, delete the colon after "embodiment".

Column 11, line 17, change "ripe" to --pipe--.

Signed and Sealed this

Fifth Day of December, 2000

*Attest:*

*Attesting Officer*

Q. TODD DICKINSON

*Director of Patents and Trademarks*